US009816230B2

(12) United States Patent
Haldane et al.

(10) Patent No.: US 9,816,230 B2
(45) Date of Patent: Nov. 14, 2017

(54) FORMATION OF HYDRATED NANOCELLULOSE SHEETS WITH OR WITHOUT A BINDER FOR THE USE AS A DERMATOLOGICAL TREATMENT

(71) Applicant: Innovatech Engineering, LLC, Tallahassee, FL (US)

(72) Inventors: David Haldane, Tallahassee, FL (US); Joshua Kearney, Tallahassee, FL (US); Jesyca Turner, Tallahassee, FL (US); Raghuram Dhumpa, Tallahassee, FL (US)

(73) Assignee: Innovatech Engineering, LLC, Tallahassee, FL (US)

( * ) Notice: Subject to any disclaimer, the term of this patent is extended or adjusted under 35 U.S.C. 154(b) by 49 days.

(21) Appl. No.: 14/986,578

(22) Filed: Dec. 31, 2015

(65) Prior Publication Data

US 2016/0186377 A1 Jun. 30, 2016

Related U.S. Application Data

(60) Provisional application No. 62/098,627, filed on Dec. 31, 2014.

(51) Int. Cl.

| | |
|---|---|
| ***D21H 11/18*** | (2006.01) |
| ***D21C 9/00*** | (2006.01) |
| ***D21C 9/18*** | (2006.01) |
| ***D21H 17/34*** | (2006.01) |
| ***D21H 17/55*** | (2006.01) |
| ***D21H 25/00*** | (2006.01) |
| ***D21H 17/52*** | (2006.01) |
| ***D21H 21/18*** | (2006.01) |
| ***D04H 1/4382*** | (2012.01) |
| ***D04H 1/732*** | (2012.01) |

(52) U.S. Cl.

CPC ..... *D21C 9/005* (2013.01); *D04H 1/4382* (2013.01); *D04H 1/732* (2013.01); *D21C 9/18* (2013.01); *D21H 11/18* (2013.01); *D21H 17/34* (2013.01); *D21H 17/52* (2013.01); *D21H 17/55* (2013.01); *D21H 21/18* (2013.01); *D21H 25/005* (2013.01)

(58) Field of Classification Search

CPC ..... D21H 11/18; D21H 21/18; D21H 11/12; D21H 11/20; D21H 17/37; D21H 17/44; D21H 17/63; D21H 17/375; D21H 17/42; D21H 17/24; D21H 17/28; D21H 17/29; D21H 17/52; D21H 17/55; D21H 17/70; D21H 17/74; D21H 19/42; D21H 23/04; D21H 27/00; D21F 11/14; D21C 9/007; D21C 5/005; D21C 9/002; D21C 5/00; D21C 9/001; D21C 9/18; B82Y 30/00; B82Y 40/00; H05K 2201/0284; Y10T 442/60; Y10T 442/613; Y10T 442/614; B01D 2239/025; B01D 39/18; D21B 1/16; Y10S 977/962; Y10S 977/963; D04H 1/4382

See application file for complete search history.

(56) References Cited

U.S. PATENT DOCUMENTS

| | | | | |
|---|---|---|---|---|
| 5,964,983 | A * | 10/1999 | Dinand | C09K 8/206 162/187 |
| 6,074,523 | A * | 6/2000 | Mizobuchi | D21F 11/14 162/102 |
| 7,381,294 | B2 * | 6/2008 | Suzuki | D21D 1/20 162/102 |
| 8,268,391 | B2 | 9/2012 | Ioelovich | |
| 8,317,978 | B1 * | 11/2012 | Manning | D21H 13/50 162/100 |
| 8,647,470 | B2 * | 2/2014 | Esser | D21H 17/42 162/157.6 |
| 8,835,141 | B2 | 9/2014 | Zhu | |
| 9,029,275 | B2 * | 5/2015 | Yano | D21H 11/08 424/488 |
| 9,181,653 | B2 * | 11/2015 | Paltakari | D21H 11/18 |
| 9,267,237 | B2 * | 2/2016 | Hentze | D21F 11/00 |
| 9,518,364 | B2 * | 12/2016 | Heiskanen | D21H 11/18 |
| 2007/0207692 | A1 * | 9/2007 | Ono | B01D 39/18 442/327 |

(Continued)

FOREIGN PATENT DOCUMENTS

| | | | | |
|---|---|---|---|---|
| FI | WO 2011055017 | A1 * | 5/2011 | D21H 21/10 |
| JP | 2005060680 | A * | 3/2005 | |

OTHER PUBLICATIONS

Siró et al., "Microfibrillated cellulose and new nanocomposite materials: a review" 2010, Cellulose 17: 459-494.*

Rebouillat et al., "State of the Art Manufacturing and Engineering of Nanocellulose: A Review of Available Data and Industrial Applications," 2013, Journal of Biomaterials and Nanotechnology, 4:165-188.*

Henriksson et al., "New nanocomposite concept based on crosslinking of hyperbranched polymers in cellulose nanopaper templates," Composites Science and Technology, 2010, pp. 1-18.*

(Continued)

*Primary Examiner* — Jose Fortuna

(74) *Attorney, Agent, or Firm* — American Patent Agency PC; Daniar Hussain

(57) ABSTRACT

The present invention is a hydrated, nanocellulose nonwoven sheet and method for manufacturing the nanocellulose sheet having dermatologically active ingredients. The sheet is formed through a high pressure or vacuum filtration process from a dilute suspension. This suspension, which contains the nanocellulose, may also contain dermatologically active ingredients. The dermatologically active ingredients are incorporated into the unwoven sheet. The dilute suspension may contain binding agents that improve the strength of the nonwoven nanocellulose sheet. These binding agents can also be cross-linked after the formation of the sheet by applying other chemical agents or treating the sheet after formation.

11 Claims, 8 Drawing Sheets

(56) References Cited

U.S. PATENT DOCUMENTS

2008/0060774 A1* 3/2008 Zuraw ..... C09D 101/00 162/135
2009/0264036 A1* 10/2009 Yano ..... D21H 11/08 442/165
2010/0065236 A1* 3/2010 Henriksson ..... D21C 9/002 162/174
2012/0094953 A1* 4/2012 Gane ..... D21B 1/16 514/57
2012/0132380 A1* 5/2012 Hentze ..... D21F 11/00 162/141
2012/0132381 A1* 5/2012 Hentze ..... D21F 11/00 162/149
2012/0132383 A1* 5/2012 Laine ..... D21H 11/18 162/175
2012/0205065 A1* 8/2012 Esser ..... D21H 17/42 162/164.6
2012/0241114 A1* 9/2012 Axrup ..... D21H 17/28 162/127
2012/0291974 A1* 11/2012 Kajanto ..... D21F 2/00 162/202
2013/0065026 A1* 3/2013 Walther ..... D21H 27/32 428/195.1
2013/0273350 A1 10/2013 Lee
2014/0038275 A1 2/2014 Gatenholm
2014/0058077 A1 2/2014 Laukkanen
2014/0155301 A1 6/2014 Nelson
2014/0186576 A1 7/2014 Harmer
2015/0017432 A1 1/2015 Shoseyov
2015/0114581 A1* 4/2015 Kinnunen ..... D21H 11/18 162/125
2015/0315747 A1* 11/2015 Heiskanen ..... D21H 11/18 162/181.2
2015/0315748 A1* 11/2015 Imppola ..... D21H 11/18 162/157.7
2016/0024718 A1* 1/2016 Lee ..... D21H 11/18 162/9
2016/0032531 A1* 2/2016 Husband ..... D21H 11/08 162/157.6
2016/0060815 A1* 3/2016 Heiskanen ..... D21H 11/18 162/9
2016/0102433 A1* 4/2016 Nuopponen ..... D21D 1/004 162/28
2016/0122947 A1* 5/2016 Kajanto ..... D21H 21/02 162/146
2016/0176989 A1* 6/2016 Laukkanen ..... C08B 15/04 162/157.6
2016/0186377 A1* 6/2016 Haldane ..... D04H 1/4382 162/184
2016/0201265 A1* 7/2016 Kosonen ..... D21H 11/18 162/175
2016/0273165 A1* 9/2016 Laine ..... D21H 11/20
2016/0289894 A1* 10/2016 Kajanto ..... D21C 5/005
2016/0319487 A1* 11/2016 Hietaniemi ..... D21H 11/18
2016/0348315 A1* 12/2016 Tanaka ..... B02C 19/06
2017/0072670 A1* 3/2017 Tajvidi ..... B32B 29/005

OTHER PUBLICATIONS

Henriksson et al., "Cellulose Nanopaper Structures of High Toughness," 2008,Biomacromolecules, 9:1579-1585.*

* cited by examiner

FORMATION OF HYDRATED NANOCELLULOSE SHEETS WITH OR WITHOUT A BINDER FOR THE USE AS A DERMATOLOGICAL TREATMENT

CROSS-REFERENCES TO RELATED APPLICATIONS

Pursuant to the provisions of 37 C.F.R. §1.53(c), this non-provisional application claims the benefit of an earlier-filed provisional patent application. The earlier application was assigned U.S. Ser. No. 62/098,627. The non-provisional application adds one additional inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of the method of manufacture of dermatological treatment products. More specifically, the invention comprises a method for forming hydrated, nonwoven nanocellulose sheets for use as dermatological treatment.

2. Description of the Related Art

Nanocellulose, or nano-structured cellulose is comprised of cellulose particles or fibers which have been exfoliated from cellulose fibrils using either mechanical or chemical means. The "nano" portion indicates that at least one dimension is measured in nanometers. This is in contrast with other fibers having similar geometry that are formed by dissolving the cellulose and regenerating it. Nanocellulose materials can be derived from wood, algae, plant or bacterial sources.

Due to the relative strength (especially in terms of strength/weight ratio), viscosity, and other mechanical properties, nanocellulose can be used for many applications. Some of the applications for nanocellulose include fillers for food products, paper towels or other paper products that benefit from the increased absorbency, reinforcing plastics, medical and pharmaceutical applications, as well as multiple other applications.

Similar to nanocellulose, hydrogels of alginate, starch, polymers or cellulose can hold a significant amount of water. For this reason, both materials are often used in situations where it is important to maintain a certain level of saturation and/or absorption. One application of hydrogels is for a dermatological mask. Hydrogels are often used for dermatological masks because of the large amount of water that hydrogels can hold. This coupled with dermatological agents allow a user to apply this saturated mask to his or her skin Unfortunately, these masks have a low degree of conformability to the skin and are not porous. This lack of porosity does not allow the skin to absorb as much of the dermatologically active ingredients. Hydrogels are cross-linked polymers which are well known in the art, especially using dermatologically active ingredients.

In addition to using cross-linked alginates, nonwoven sheets with dermatologically active ingredients may be used for dermatological masks. These nonwoven sheets are formed using long fibers which are bonded together using chemical, mechanical, heat, or solvent treatment. A flat, porous sheet is typically formed using this method.

Therefore, what is needed is a device and method which is capable of transpiring or evaporating water through a dermatological mask, thereby causing a dynamic fluid system between the skin beneath the sheet and the sheet itself. Additionally, a method which is capable of incorporating particulates and solution-based active ingredients at many different phases of the method, allowing for evenly dispersed ingredients is needed. The present invention achieves this objective, as well as others that are explained in the following description.

BRIEF SUMMARY OF THE INVENTION

The present invention comprises a hydrated, nanocellulose nonwoven sheet and method for manufacturing the nanocellulose sheet. The hydrated, nanocellulose sheet is formed through a high pressure or vacuum filtration process from a dilute suspension. This suspension, which contains the nanocellulose, may also contain dermatologically active ingredients. The dermatologically active ingredients are preferably incorporated into the unwoven sheet during the filtration process. In addition, the dilute suspension may contain binding agents that improve the strength of the nonwoven nanocellulose sheet. These binding agents can also be "activated" or cross-linked after the formation of the sheet by applying other chemical agents or treating the sheet after formation. In another embodiment, dermatologically active ingredients are applied to the sheet after formation of the sheet.

Preferably, the elements and process of manufacturing the hydrated, nanocellulose nonwoven sheet produces several advantageous properties. These properties include a high conformability, drape-ability, large surface area, good level adhesion to the skin of a user, ability to contain nano- and micro-particles, and high rate of evaporation of water from the sheet. These properties make the material ideal for resting against the skin of the user and delivering dermatological agents which have been shown to be difficult to deliver or which require multi-step processes to deliver to the skin.

REFERENCE NUMERALS IN THE DRAWINGS

Figure 1:
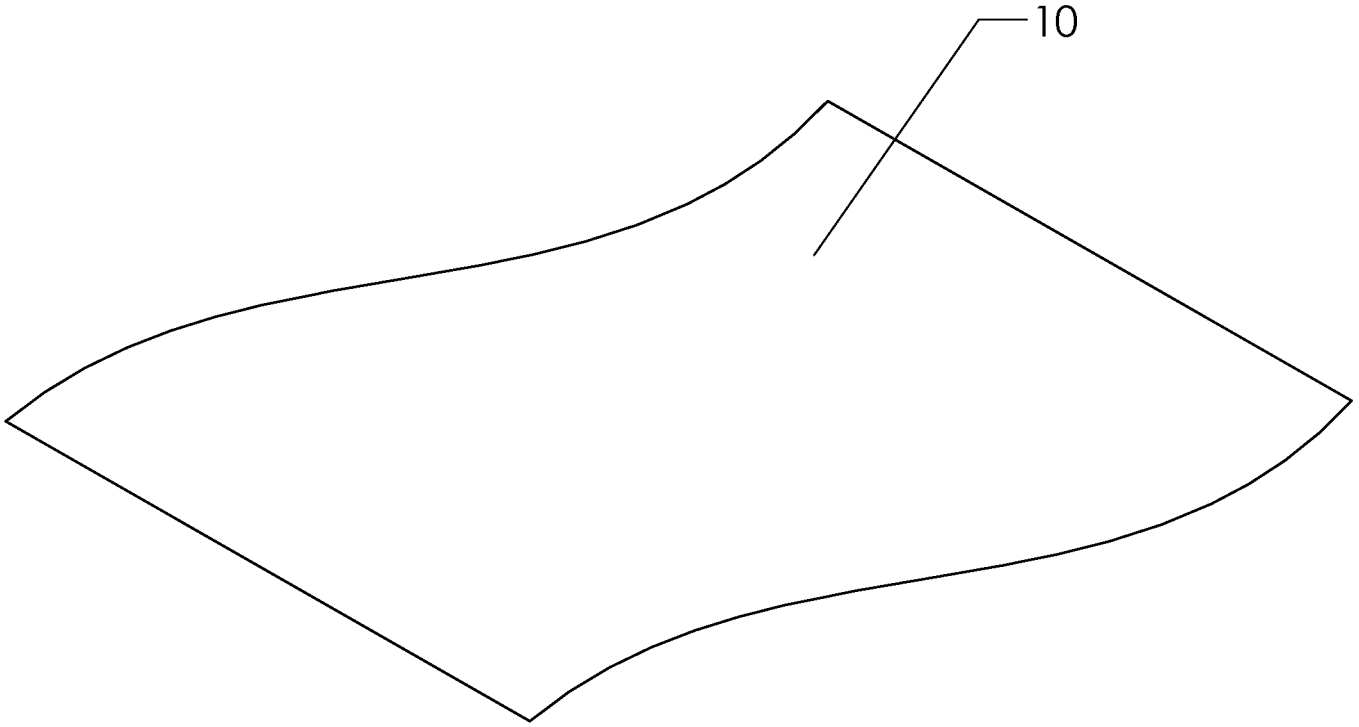
FIG. 1 is a perspective view of a nanocellulose sheet manufactured by the present method.

10 sheet
12 mask
13 eye mask
14 providing purified nanocellulose (step 1)
15 side of face mask
16 diluting nanocellulose into a suspension medium (step 2)
17 neck mask
18 placing first suspension into dispensing device
20 diluting a cross-linking agent in a solvent to form a cross-linking solution
22 dispensing first suspension into cross-linking solution
24 collecting a formed gel
26 re-dispersing formed gel in a solution to form a second suspension
28 filtering second suspension such that a sheet is formed
30 dipping formed sheet into a binding and/or cross-linking agent
32 dipping formed sheet into an ingredient slurry
34 cutting sheet into a form
36 packaging sheet
38 adding a binding agent to first suspension
40 adding an amount of ingredients to first suspension

DETAILED DESCRIPTION OF THE INVENTION

The present invention provides a method for producing a hydrated, nanocellulose nonwoven sheet 10, as shown in FIG. 1. The present invention uses a novel process of manufacturing in order to create a nanocellulose nonwoven sheet. This sheet is formed by utilizing nanocellulose. Nanocellulose refers to nano-structured cellulose. In the present invention, this may be either cellulose nanofibers (also called microfibrillated cellulose) or nanocrystalline cellulose (crystals). Preferably, the nanocellulose is extracted from wood pulp cellulose. Pre-treatments can be used, such as TEMPO-mediated oxidation. Thus, the sheet can also be formed by using TEMPO-oxidized nanocellulose. Of course, any combination or source can be used for the nanocellulose in order to create sheet 10. Once sheet 10 is formed, the details of which are discussed and illustrated at length in the subsequent text, sheet 10 is cut into different shapes. The following discussion describes and illustrates many of the possible applications of the sheet 10. The following discussion should not, however, limit the scope of the applications of the invention.

Generally, the method is capable of forming a hydrated nanocellulose sheet 10 (illustrated in FIG. 1). Once a nanocellulose sheet 10 is formed, it can be cut into a form which is capable of applying to the skin of a user. The form can be any different shape, size or configuration. The different shapes and sizes formed can be used for different applications. These applications are mainly based in dermatology, including wound healing, cosmetology, and other applications involving the skin. The following illustrations, FIGS. 2A-2D, are illustrations of different applications for nanocellulose sheet 10.

Figure 2A:
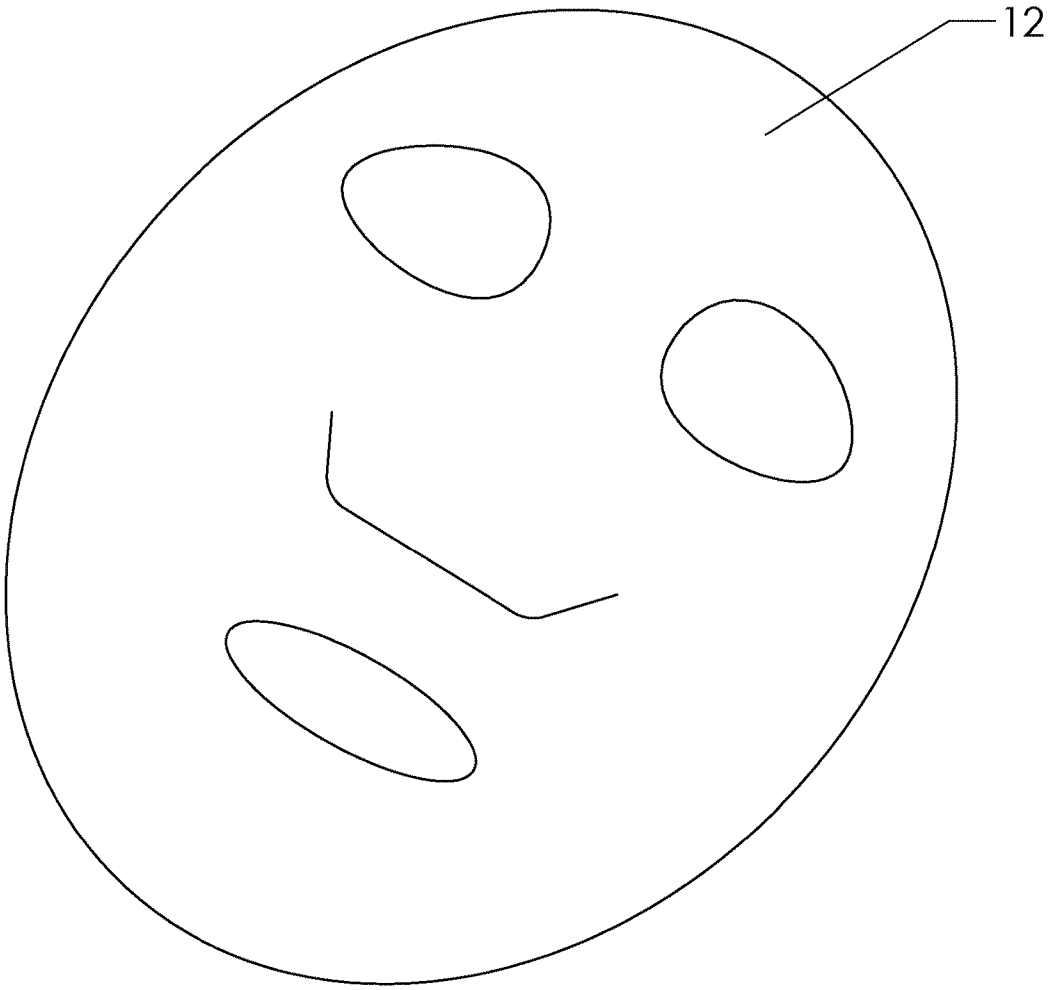
FIG. 2A is a perspective view of a nanocellulose sheet manufactured by the present method and formed into a mask.

FIG. 2A shows a mask 12 which has been cut from a nanocellulose sheet 10. This mask 12 can be applied to a user's entire face. Due to the method of manufacture of sheet 10 (and therefore mask 12) has advantageous properties, further discussed herein, that prior art masks or other applications of sheet were not capable of achieving.

Figure 2B:
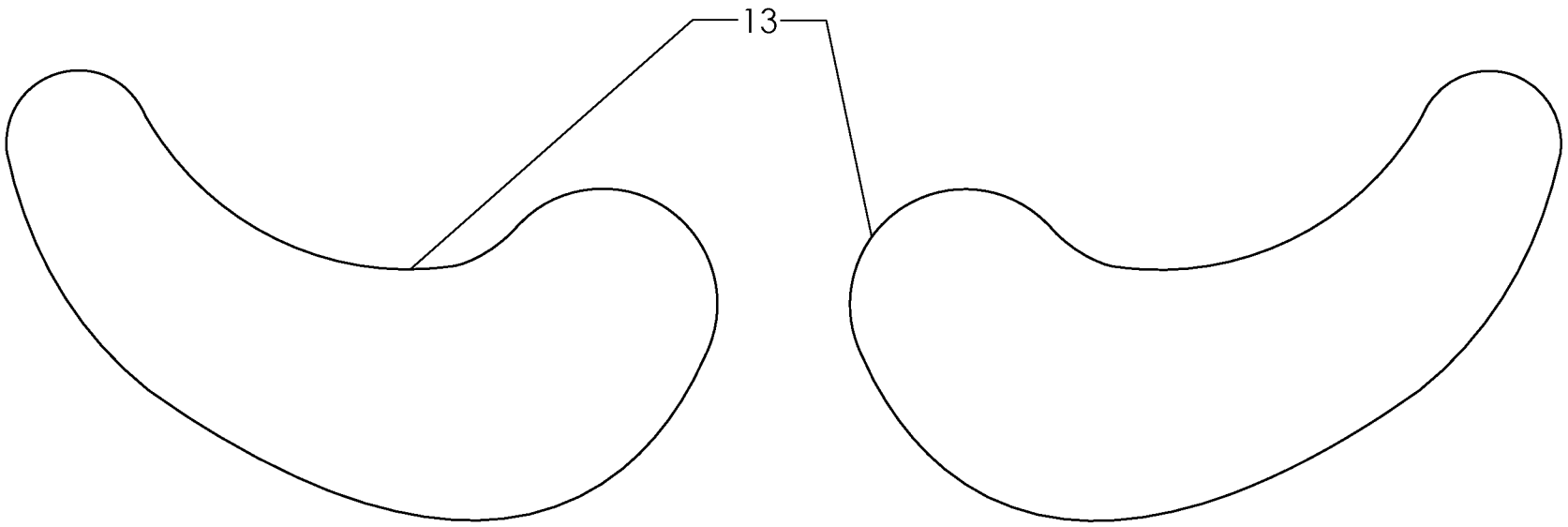
FIG. 2B is a perspective view of a nanocellulose sheet manufactured by the present method and formed into eye masks.
Figure 2C:
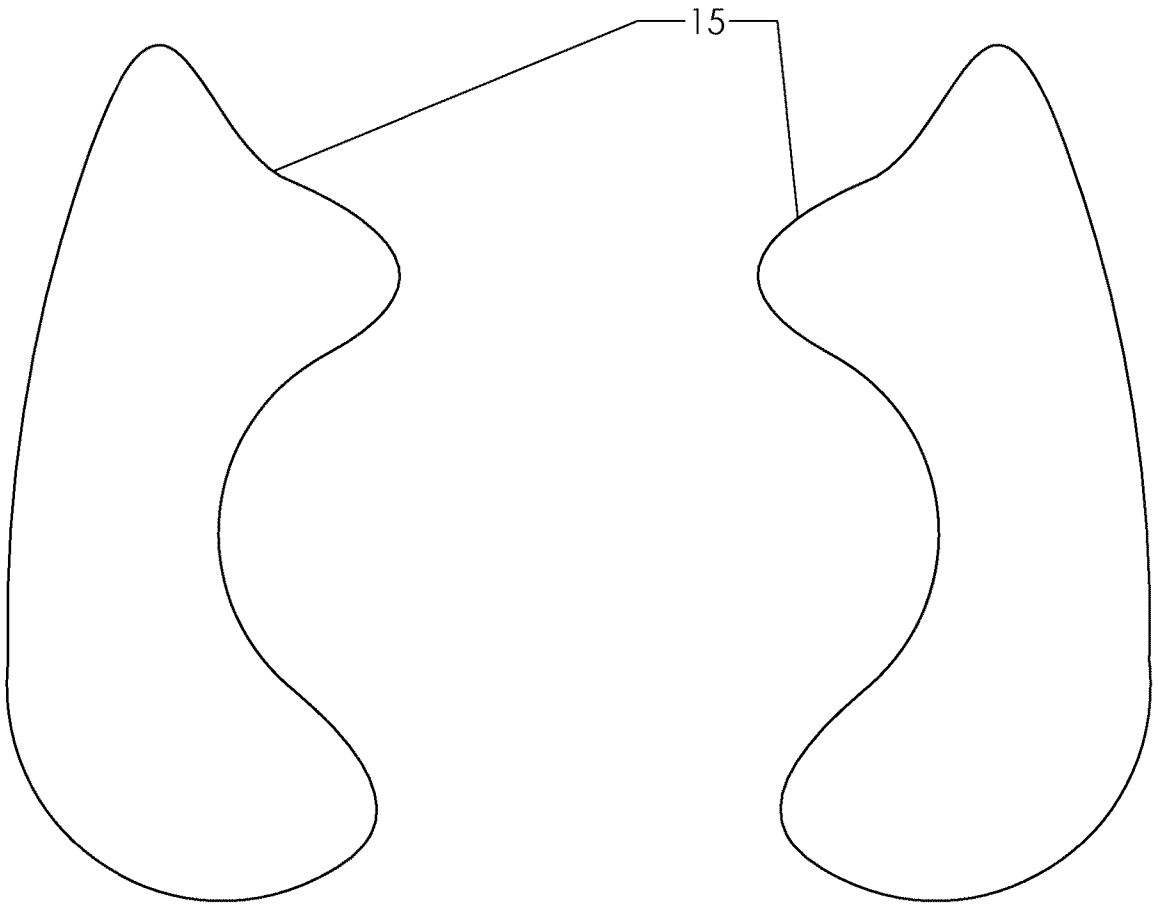
FIG. 2C is a perspective view of a nanocellulose sheet manufactured by the present method and formed into side of face masks.
Figure 2D:
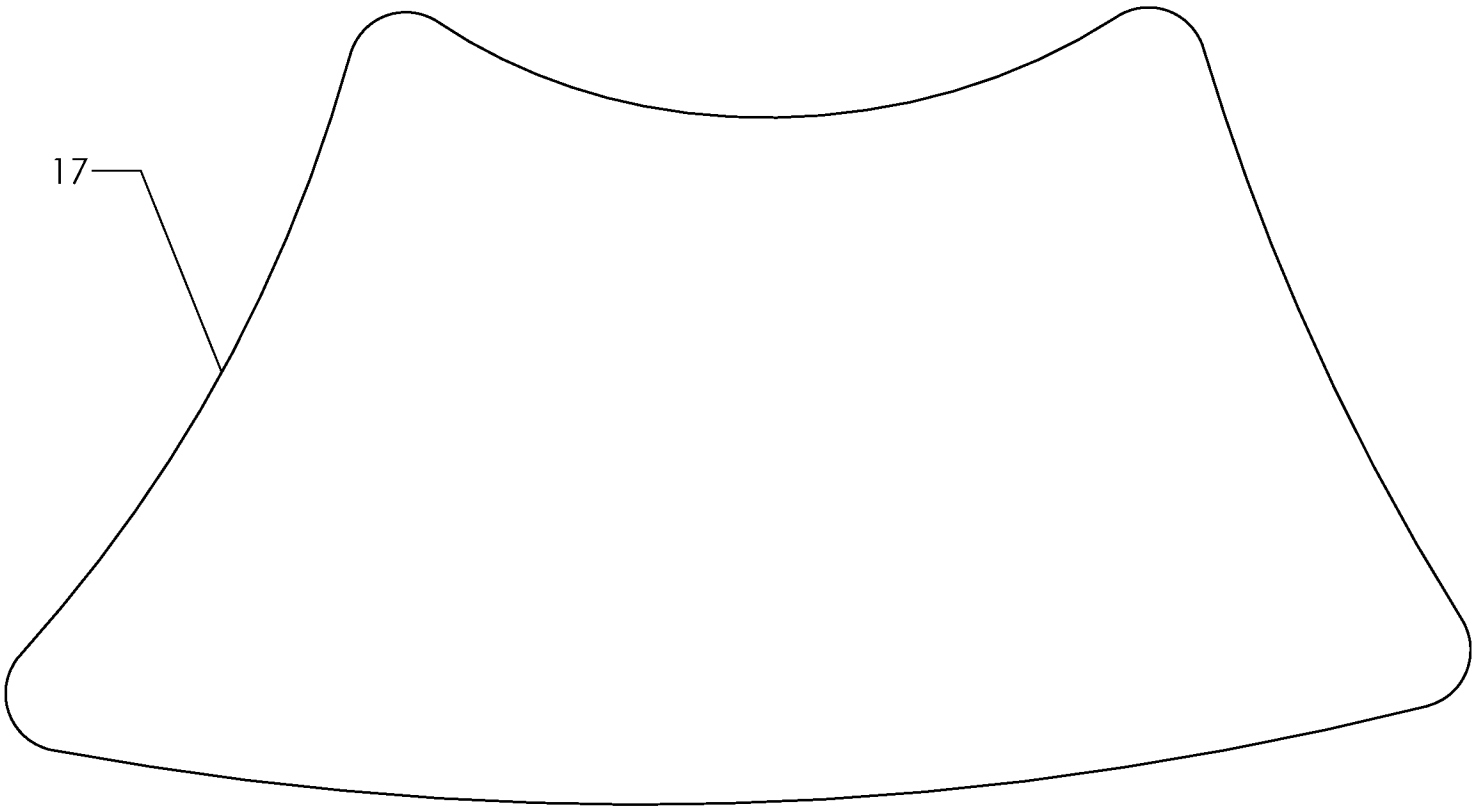
FIG. 2D is a perspective view of a nanocellulose sheet manufactured by the present method and formed into a neck mask.

FIG. 2B shows another embodiment of the present invention. In this embodiment of the present invention, sheet 10 has been cut into a form of under eye masks 13. As shown, each under eye mask 13 is cut in a shape that fits under the eye of a patient. FIG. 2C shows an embodiment of the present invention which has multiple applications. Side of face masks 15 can be applied to either side of a user's mouth or on either side of a user's eyes. These are locations on a user's face which are typically targeted with dermatological ingredients. FIG. 2D shows another embodiment of the present invention. Neck wrap 17 is a form that can be wrapped around the neck of a user in order to apply dermatological ingredients to a user's neck.

In each embodiment of the present invention, the nanocellulose nonwoven sheet achieves a similar end—formation of a hydrated, nanocellulose nonwoven sheet which incorporates dermatological active ingredients in order to enhance the effects of applying a dermatological sheet mask 12.

Figure 3:
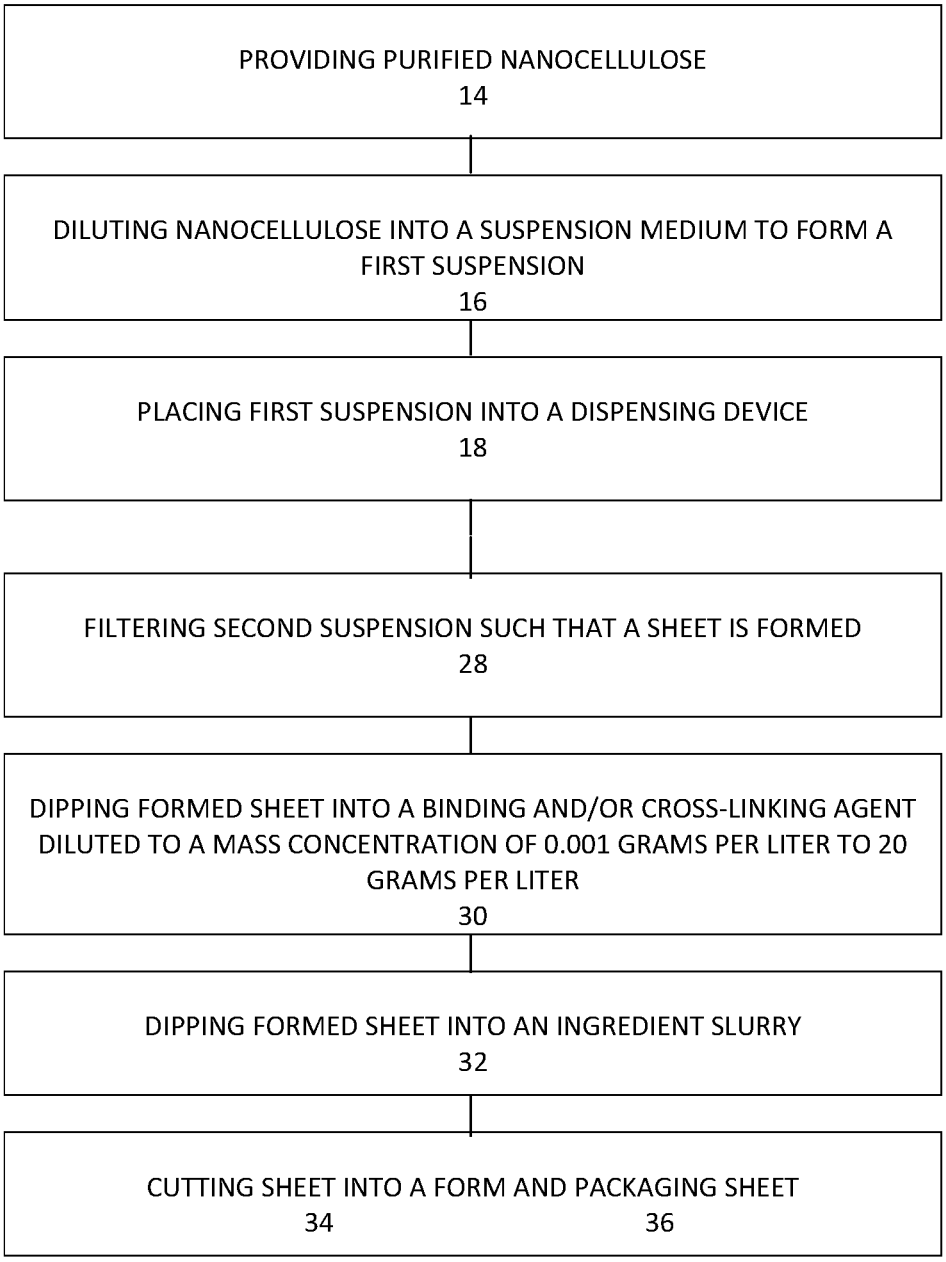
FIG. 3 is a diagram of the steps of one embodiment of the present method of manufacture.

Generally, the method comprises producing a nanocellulose sheet 10 by a series of steps. The desired nanocellulose sheet 10 is achieved independent of the specific order of the steps after step 1 and 2. As shown in FIG. 3, step 1 comprises providing purified nanocellulose. The present method can utilize nanocellulose having any diameter and length. For example, the nanocellulose may have a diameter of 5 to 100 nm and length of up to 10 microns. In step 2, the nanocellulose is diluted into a suspension to a mass concentration of 0.1 gram per liter to 10 grams per liter. The nanocellulose can be diluted with any suspension medium capable of being combined with the cellulose to form a stable suspension. For example, water, alcohols or oil (having a surfactant) can be used as the suspension medium.

Generally, the remaining steps of the method comprise the steps of, at least: Placing suspension into a dispensing device for micro-filtration; Preparation of a cross-linking solution such as calcium lactate, calcium chloride, calcium stearate or oil, which is capable of cross-linking or "setting" the binding agent, where relevant; Application of cross-linking solution; and collection of the formed sheet.

The dispensing device can be any device that is capable of micro-filtration and/or fabricating sheets of nanomaterials. The device disclosed in U.S. application Ser. No. 14/186,795 is one example of a device that can be used in the present method. During the filtration process, the device or filter removes water from the suspension leaving a solid sheet. The solid sheet is, in one example, 20-80% solids.

The claimed method of manufacturing comprising the formation of hydrated nanocellulose sheets with or without a binder for the use as a dermatological treatment also includes several optional steps capable of being utilized in various method embodiments.

For example, optional steps include the addition of particulate dermatologically active ingredients or desired base material modifiers, collectively "ingredients" (some examples of base material modifiers are other forms of cellulose fibers, other forms of nanofibers, nanoclay, extended release particles, and micro-encapsulates), addition of wet binding agent/gelling agent, such as sodium alginate or agar, to a mass concentration of 0.01 grams per liter to 10 grams per liter, dewatering of sheet to a 10-70% water content, collection and re-dispersion of gel in solution by mixing or blending, filtration of suspension with positive pressure or vacuum to the filter paper, addition of liquid active agents to formed sheet and/or packaging of material in gas impermeable package.

Generally, the method is capable of forming a hydrated nanocellulose sheet 10 (illustrated in FIG. 1). As discussed above, once a nanocellulose sheet 10 is formed it can be cut into different shapes, sizes, and configurations (illustrated in FIG. 2A-2D). Due to the method of manufacture of nanocellulose sheet 10, it has advantageous properties that prior art sheets were not capable of achieving. For example, nanocellulose sheet 10 has a high conformability and drapeability, a high surface area, a good level of adhesion to the skin, the ability to trap nano and micro particles, and a high rate of evaporation of water from the sheet. Conformability, drape-ability, high surface area and adhesion to the skin are characteristics that make the material ideal for lying against the skin and delivery dermatological agents. The ability to contain nano and micro particles, as well as absorbing aqueous solutions make the material ideal as a delivery mechanism for dermatological agents that have been difficult to deliver or require multi-step processes to deliver to the skin. Thus, nanocellulose sheet 10 (in any form, examples include FIGS. 2A-2D) is capable of delivering dermatological agents or other ingredients more effectively and for a longer period of time than prior art sheets, including, but not limited to facial masks, eye masks, neck wrap, etc.

Nanocellulose is defined as cellulose particles or fibers that have at least one dimension that is measured in nanometers which have been exfoliated from cellulose fibrils via mechanical or chemical processes. Nanocellulose can be produced from many sources including bacterial, plant, wood, algal or fruit waste. In the present method, it is important that the steps include the dilution of nanocellulose into a suspension, instead of processing a grown pellicle of nanocellulose (such as is common in bacterially grown cellulose). The delivery of the nanocellulose in a suspension allows the process to accept nanocellulose from multiple sources. Nanocellulose can be pre-treated during formation. Examples of such pre-treatment include mechanical or enzymatic treatment of a cellulose containing material. Cellulose containing material can be oxidized using 2,2,6,6-tetramethylpiperidin-1-oxyl radical ("TEMPO"), which introduces charged groups. Carboxymethoylation can also be used to pre-treat the cellulose containing material. Finally, acid hydrolysis, such as acid hydrolysis can be used to treat the cellulose containing material.

The present method, although not required, allows ingredients to be added at different stages of formation of the sheet. The addition of the ingredients at different stages allows interaction and binding of ingredients prior to full formation of the sheet. The ingredients bind closely to the nanocellulose. The ingredients are therefore imbedded or absorbed at this stage. This method is capable of achieving even dispersion of ingredients through the thickness of the material. A greater concentration of ingredients is attained than would be by simply allowing a formed sheet to absorb the ingredients. Ingredients can be any ingredients which are added to the sheet 10 during the manufacture for delivery to the skin of the user or to modify the properties of the sheet itself (e.g. increase its permeability). These ingredients can be for use in many industries, such as cosmetic or pharmaceutical. While any known ingredients can be used, some examples include silver, collagen, proteins, fragrances or antioxidants (e.g. blended green tea).

In one embodiment of the present method, illustrated in FIG. 3, sheet 10 is manufactured by a method (method A), without adding a binder or active ingredients before the sheet is formed. Such method generally comprising the steps of:

(1) Providing purified nanocellulose material or its combination.

(2) Dilution of nanocellulose 16 into a first suspension to a mass concentration of 0.1 gram per liter to 10 grams per liter. The nanocellulose can be diluted with any suspension medium capable of being combined with the nanocellulose to form a stable suspension. For example, $H_2O$, alcohol or oil (having a surfactant) can be used as the suspension medium.

(3) Placement of suspension into a dispensing device 18.

(4) Filtration of suspension with positive pressure or vacuum to the filter paper 28 such that a sheet is formed.

(5) Dipping formed sheet into a binding and/or cross linking agent. The manufacturer can dip sheet into a binding agent solution wherein the binding agent solution is a binding agent diluted to a mass concentration of 0.01 grams per liter to 10 grams per liter and/or dip sheet into a cross linking solution wherein said cross linking solution is a cross linking agent diluted to a mass concentration of 0.001 grams per liter to 20 grams per liter.

(6) Dipping formed sheet into an ingredient slurry 32.

(7) Cutting sheet into a form 34, such as a facial mask, neck wrap, under eye masks, to name a few.

(8) Packaging of sheet, such as in gas impermeable package 36.

In this embodiment, the method is capable of forming a nanocellulose sheet 10 which allows for the incorporation of particulate and solution-based active ingredients in the formation of the material. However, the aqueous solution of nanoparticles does not require use of binders, fillers or adhesives.

Figure 4:
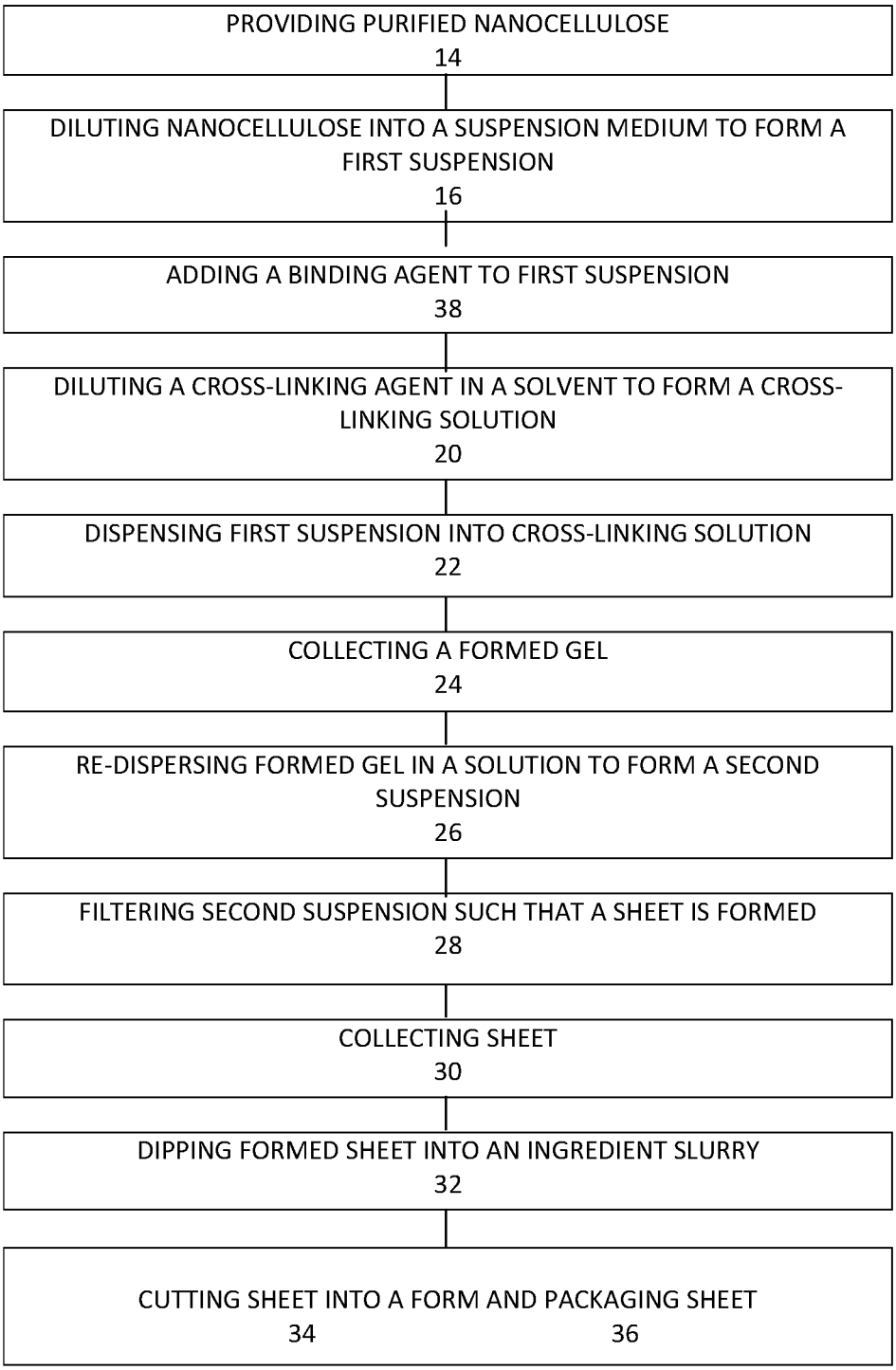
FIG. 4 is a diagram of the steps of another embodiment of the present method of manufacture.

Another embodiment of the present invention, method B, is illustrated in FIG. 4 and generally comprises the following steps:

(1) Providing purified nanocellulose material or its combination, (2) Dilution of nanocellulose 16 into a first suspension to a mass concentration of 0.1 gram per liter to 10 grams per liter. The nanocellulose can be diluted with any suspension medium capable of being combined with the nanocellulose to form a stable suspension. For example, $H_2O$, alcohol or oil (having a surfactant) can be used as the suspension medium.

(3) Addition of binding agent to first suspension 38 to a mass concentration of 0.01 grams per liter to 10 grams per liter to form a binding agent solution.

(4) Diluting cross-linking agent 20 in a solvent (such as water) to a mass concentration of 0.001 grams per liter to 20 grams per liter to form a cross-linking solution, wherein said cross-linking agent can be calcium lactate, calcium chloride, calcium stearate or oil.

(5) Dispensing first suspension into cross-linking solution 22.

(6) Collection of formed gel from cross-linking solution 24.

(7) Re-dispersing the formed gel in a solution to form a second suspension 26.

(8) Filtration of the second suspension with positive pressure or vacuum to the filter paper 28.

(9) Collection of formed sheet 30.

(10) Dipping formed sheet into an ingredient slurry 32.

(11) Cutting sheet into a form 34, such as a facial mask, neck wrap, under eye masks, to name a few.

(12) Packaging of sheet in gas impermeable package 50.

Figure 5:
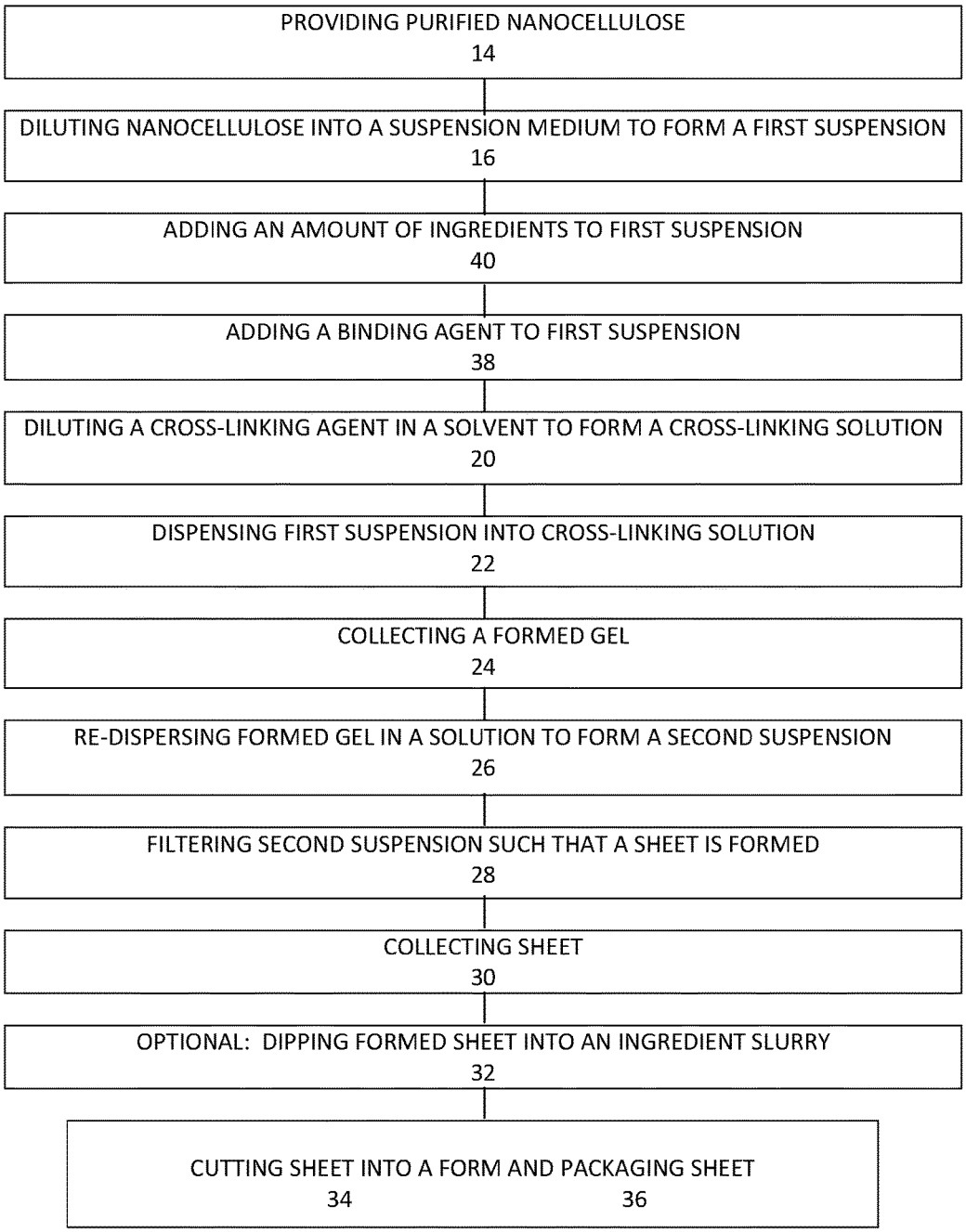
FIG. 5 is a diagram of the steps of another embodiment of the present method of manufacture.

In another embodiment of the present invention, method C, illustrated in FIG. 5, the steps for manufacturing the unwoven sheet are:

(1) Providing purified nanocellulose material or its combination 14.

(2) Dilution of nanocellulose 16 into a first suspension to a mass concentration of 0.1 gram per liter to 10 grams per liter. The nanocellulose can be diluted with any suspension medium capable of being combined with the nanocellulose to form a stable suspension. For example, $H_2O$, alcohol or oil (having a surfactant) can be used as the suspension medium.

(3) Addition of particulate 20 dermatologically active ingredients or desired base material modifiers. Some examples of base material modifiers are nanoclay, extended release particles, and microencapsulates.

(4) Addition of wet binding agent/gelling agent 38, such as sodium alginate or agar, to first suspension to a mass concentration of 0.01 grams per liter to 10 grams per liter. Although sodium alginate and agar are used as examples, the binding agent/gelling agent can be any polycationic, such as polyamidoamine-epichlorohydrin or KYMENE, and/or anionic such as carboxymethylcellulose or Hyaluronic acid.

(5) Diluting cross-linking agent 20, such as calcium citrate, calcium lactate, calcium chloride, calcium stearate or oil, appropriate to selected wet binding agent in a solvent (such as water) to a mass concentration of 0.001 grams per liter to 20 grams per liter to form a cross-linking solution.

(6) Dispensing first suspension into cross-linking solution 22.

(7) Collection of formed gel from cross-linking solution 24.

(8) Re-dispersion of gel in solution by mixing or blending 26 to form a second suspension.

(9) Filtration of suspension 28 with positive or vacuum pressure until sheet is formed.

(10) Collection of formed sheet 30.

(11) Optionally adding liquid or solid active agents or ingredients by dipping formed sheet into an ingredient slurry 32.

(12) Packaging of sheet in, for example, a gas-impermeable package 50.

Method C allows for the incorporation of particulate dermatologically active ingredients 20 before and after the addition of the wet binding agent 38. Thus, the active ingredients can be uniformly dispersed throughout the thickness of the sheet 10, allowing sheet 10 to accept active ingredients in greater proportions.

The preceding description contains significant detail regarding the novel aspects of the present method. It should not be construed, however, as limiting the scope of the invention but rather as providing illustrations of the preferred embodiments of the invention.

Having described my invention, we claim:

1. A method of manufacture for forming a hydrated, nonwoven nanocellulose sheet, said method comprising the steps of:

providing an amount of nanocellulose;

forming a first suspension by diluting said amount of nanocellulose into a suspension medium;

forming a binding agent solution by adding a binding agent to said first suspension to a mass concentration of 0.01 grams per liter to 10 grams per liter;

forming a cross-linking solution by diluting a cross-linking agent in a solvent to a mass concentration of 0.001 grams per liter to 20 grams per liter to form a cross-linking solution;

forming a gel by dispensing said binding agent solution into said cross-linking solution;

collecting said gel from said cross-linking solution;

forming a second suspension by re-dispersing said gel into a solvent; and forming the hydrated, nonwoven nanocellulose sheet by placing said second suspension into a dispensing device to filter said second suspension.

2. The method of manufacture of claim 1, further comprising the step of cutting said sheet into a predetermined shape and size.

3. The method of manufacture of claim 2, further comprising the step of packaging said sheet after the cutting step.

4. The method of manufacture of claim 1, further comprising the step of adding an amount of a dermatologically active ingredient to said first suspension after forming said first suspension.

5. The method of manufacture of claim 4, wherein said dermatologically active ingredient comprises an oil component and an alkyl-modified carboxyvinyl polymer component.

6. The method of manufacture of claim 4, wherein a diameter of said nanocellulose is 5 to 100 nm and a length of said nanocellulose is up to 10 microns.

7. The method of manufacture of claim 4, wherein said dermatologically active ingredient is selected from the group consisting of silver, collagen proteins, fragrances, and antioxidants.

8. The method of manufacture of claim 7, further comprising the step of cutting said sheet into a predetermined shape and size.

9. The method of manufacture of claim 8, further comprising the step of packaging said sheet after the cutting step.

10. The method of manufacture of claim 8, wherein said predetermined shape and size is a facial mask.

11. The method of manufacture of claim 7, wherein said dermatologically active ingredient comprises an oil component and an alkyl-modified carboxyvinyl polymer component.

* * * * *